US007381141B2

(12) United States Patent
Van Nguyen

(10) Patent No.: US 7,381,141 B2
(45) Date of Patent: Jun. 3, 2008

(54) MULTI-COMPONENT BAT AND ASSEMBLY PROCESS

(76) Inventor: Thu Van Nguyen, 24128 Hillhurst Dr., West Hills, CA (US) 91307

( * ) Notice: Subject to any disclaimer, the term of this patent is extended or adjusted under 35 U.S.C. 154(b) by 8 days.

(21) Appl. No.: 11/307,994

(22) Filed: Mar. 2, 2006

(65) Prior Publication Data

US 2007/0207882 A1 Sep. 6, 2007

(51) Int. Cl.
*A63B 59/06* (2006.01)

(52) U.S. Cl. ..... 473/566; 473/567

(58) Field of Classification Search ..... 473/457, 473/519, 520, 564–568
See application file for complete search history.

(56) References Cited

U.S. PATENT DOCUMENTS

| | | | | |
|---|---|---|---|---|
| 3,877,698 | A | 4/1975 | Volpe | |
| 4,025,377 | A | 5/1977 | Tanikawa | |
| 4,951,948 | A * | 8/1990 | Peng | 473/520 |
| 5,219,164 | A * | 6/1993 | Peng | 473/520 |
| 5,277,421 | A * | 1/1994 | Rewolinski | 473/457 |
| 5,409,214 | A | 4/1995 | Cook | |
| 5,516,097 | A * | 5/1996 | Huddleston | 473/457 |
| 5,593,158 | A | 1/1997 | Filice et al. | |
| 5,722,908 | A | 3/1998 | Feeney et al. | |
| 6,042,493 | A | 3/2000 | Chauvin et al. | |
| 6,050,908 | A * | 4/2000 | Muhlhausen | 473/457 |
| 6,056,655 | A | 5/2000 | Fenney et al. | |
| 6,432,006 | B1 | 8/2002 | Tribble | |
| 6,485,382 | B1 | 11/2002 | Chen | |
| 6,511,392 | B1 | 1/2003 | Chohan | |
| D476,709 | S | 7/2003 | Nguyen | |
| 6,625,848 | B1 * | 9/2003 | Schneider | 16/436 |
| 6,702,698 | B2 | 3/2004 | Eggiman et al. | |
| 6,808,464 | B1 | 10/2004 | Nguyen | |
| 6,929,573 | B1 * | 8/2005 | Chang | 473/567 |
| 2004/0224801 | A1 * | 11/2004 | Forsythe et al. | 473/564 |
| 2005/0003913 | A1 * | 1/2005 | Guenther et al. | 473/564 |
| 2005/0059515 | A1 * | 3/2005 | Chang | 473/564 |
| 2005/0221924 | A1 * | 10/2005 | Sutherland et al. | 473/564 |
| 2005/0277497 | A1 * | 12/2005 | Chang | 473/567 |

* cited by examiner

*Primary Examiner*—Mark S Graham
(74) *Attorney, Agent, or Firm*—Kelly Lowry & Kelley LLP

(57) ABSTRACT

A process for assembling a multi-component baseball bat includes providing a bat barrel having an end with a plurality of slots and selecting a bat handle. A section of the handle is enveloped by the end of the barrel. The barrel and handle are interconnected in coaxial engagement to define an intermediate tapered section which returns energy and power to the barrel that emanates from the barrel due to an impact of a ball on the barrel. An example of a multi-component baseball bat formed by the process includes a bat barrel having a plurality of slots; a bat handle; and a connector attached to an end of the handle. The connector engages the slots of the barrel and is coaxially disposed between the barrel and the handle for interconnecting the barrel and handle in an aligned relation, to return energy and power to the barrel.

23 Claims, 4 Drawing Sheets

MULTI-COMPONENT BAT AND ASSEMBLY PROCESS

BACKGROUND OF THE INVENTION

The present invention relates to baseball and softball bats. More particularly, the present invention relates to a multi-component bat and a related assembly process.

Baseball and softball are very popular sports in the United States, Mexico, Cuba, Japan and elsewhere. Due to the competitive nature of the sports, players are constantly seeking ways of improving their performance. An important aspect of baseball and softball is the ability to effectively hit the ball. Aluminum (metal) bats are allowed in baseball amateur play from Little League to College levels. Metal bats are also typically used in slow and fast pitch softball. Such bats are advantageous over wood bats in that they do not break and splinter like wood bats and thus can be repeatedly used with consequent cost savings. Metal bats also have a larger optimal hitting area or power zone (commonly referred to as the "sweet spot") than wood bats. Furthermore, the ball comes off a metal bat faster than a wood bat resulting in longer hits.

However, metal bats have certain disadvantages. Metal bats vibrate upon impact and may send painful vibrations into the hands and arms of the batter if the ball is not hit within the power zone of the bat. Metal bats, particularly aluminum bats, may also dent or otherwise deform due to forceful impacts with the ball. Metal bats also emit an undesirable high-pitched metallic sound, as opposed to the traditional sound heard when a wood bat contacts the ball.

Various attempts have been made to overcome the problems associated with metal bats. Some attempts have been to coat or wrap the exterior of the metal bat with materials such as carbon reinforcing fibers to enhance batting performance. These externally wrapped bats have been found to be aesthetically unpleasant and lacking in significant improvement. Other attempts have been made to insert internal layers or compartments within the metal bat to improve performance. Bats have been devised that incorporate both metal and composite materials. Such designs include utilizing multiple-layered graphite inserts to provide durability and flexibility to the bat, tubular coiled spring steel inserts to improve the spring-board effect when the ball contacts the bat, and pressurized air chambers within the bat. Bats that incorporate composite materials tend to be much lighter than metal bats. While providing benefits, these designs also have drawbacks. Some designs are very expensive to manufacture and are prone to structural failure. The composite sheaths break down over time, the bats are subject to premature longitudinal cracks in the barrel of the bat and damage is created at an interface of the metal and composite materials due to differences in the impact absorption and resistance characteristics of the materials.

Accordingly, there is a need for a bat which enhances the performance of the bat and overcomes the disadvantages previously experienced with metal bats. The present invention fulfills these needs and provides other related advantages.

SUMMARY OF THE INVENTION

The present invention resides in an apparatus and process that provides a multi-component bat. As illustrated herein, a multi-component baseball bat embodying the present invention includes a bat barrel having a plurality of slots; a bat handle; and a connector attached to an end of the handle. The connector engages the slots of the barrel and is coaxially disposed between the barrel and the handle for interconnecting the barrel and handle in an aligned relation in order to return energy and power to the barrel that emanates from the barrel due to an impact of a ball on the barrel. The slots of the barrel receive a portion of the connector therein, reducing speed of vibrations traveling from the barrel to the handle that were created when the ball contacted the bat.

The connector comprises, at least in part, an intermediate tapered section between the bat barrel and bat handle. The connector also comprises a hollow, tapered sleeve coaxially disposed around an exterior of the handle, having a plurality of outwardly extending protrusions for engaging respective slots in the barrel. The connector is adhered about a cylindrically tapered guide extending longitudinally from the end of the handle.

A section of the barrel envelopes an end of the handle. The section of the barrel also envelopes the connector.

The engagement of the barrel, handle and connector provides a generally continuous exterior surface of the baseball bat when the handle engages the barrel. The engagement of the barrel, handle and connector also increases sweet spot size on the barrel.

The process for assembling a multi-component baseball bat includes providing a bat barrel having an end with a plurality of slots. As part of the process, a bat handle is also selected with a section of the handle eventually being enveloped with the end of the barrel when the barrel and handle are interconnected in coaxial engagement to define an intermediate tapered section which returns energy and power to the barrel that emanates from the barrel due to an impact of a ball on the barrel. With a hollow tapered sleeve coaxially disposed around the handle, protrusions extending outwardly from the sleeve engage within respective slots disposed about the end of the barrel. A further step includes adhering the sleeve to the handle; a portion of the sleeve also being disposed between the handle and barrel. Engagement of the protrusions and slots reduces the speed of vibrations traveling from the barrel to the handle when the ball contacts the bat. The interconnection of the barrel and handle forms an energy block which increases sweet spot size on the barrel.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
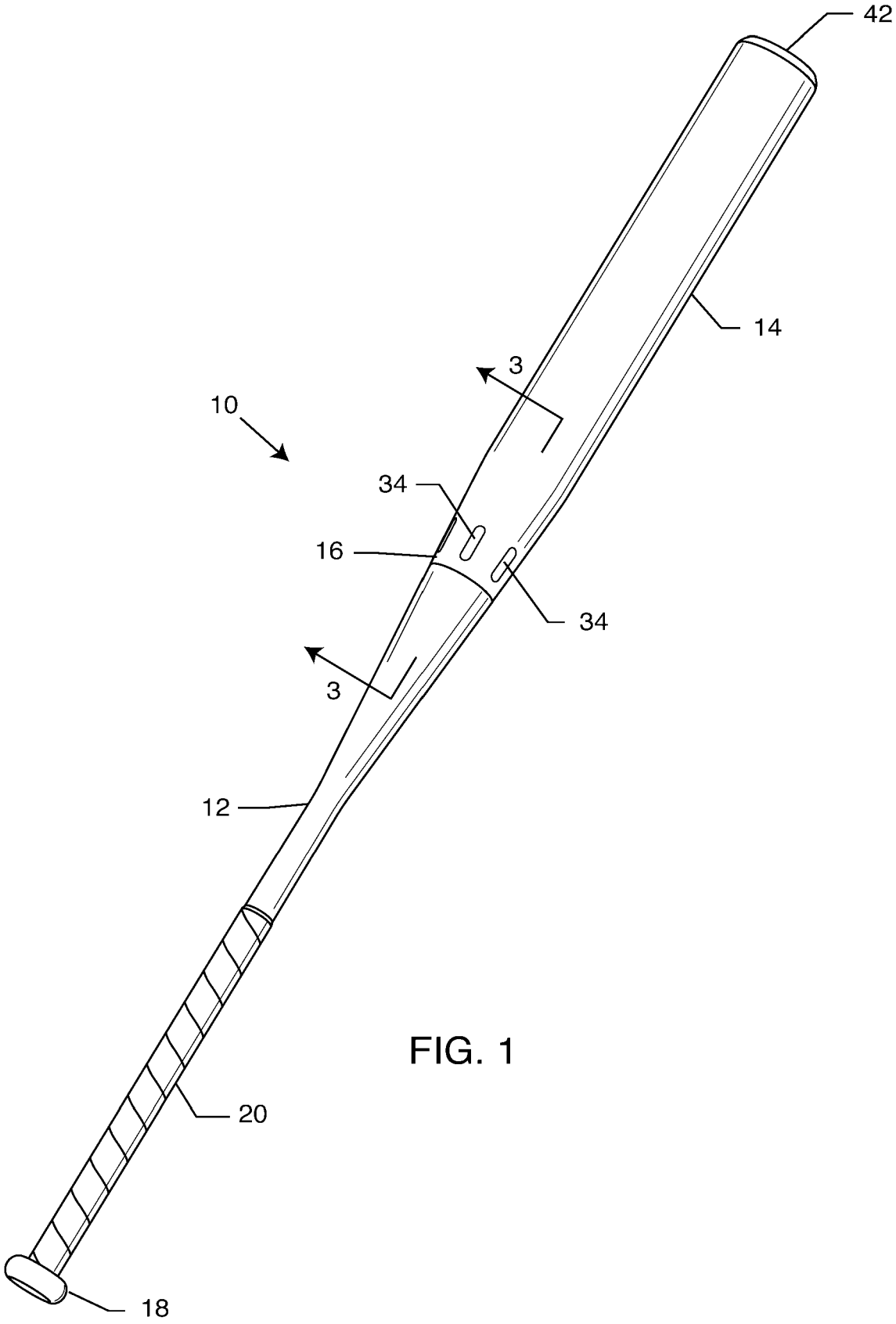
FIG. 1 is a perspective view of a baseball bat embodying the present invention.
Figure 2:
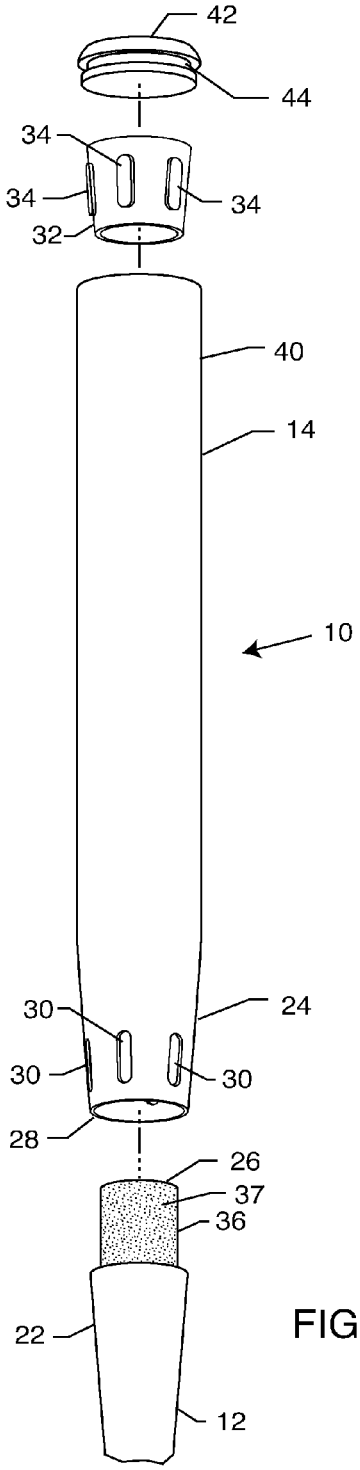
FIG. 2 is an exploded perspective view of a bat barrel, bat handle, and mechanism for interconnecting the bat barrel and the handle to form the baseball bat of FIG. 1.
Figure 3:
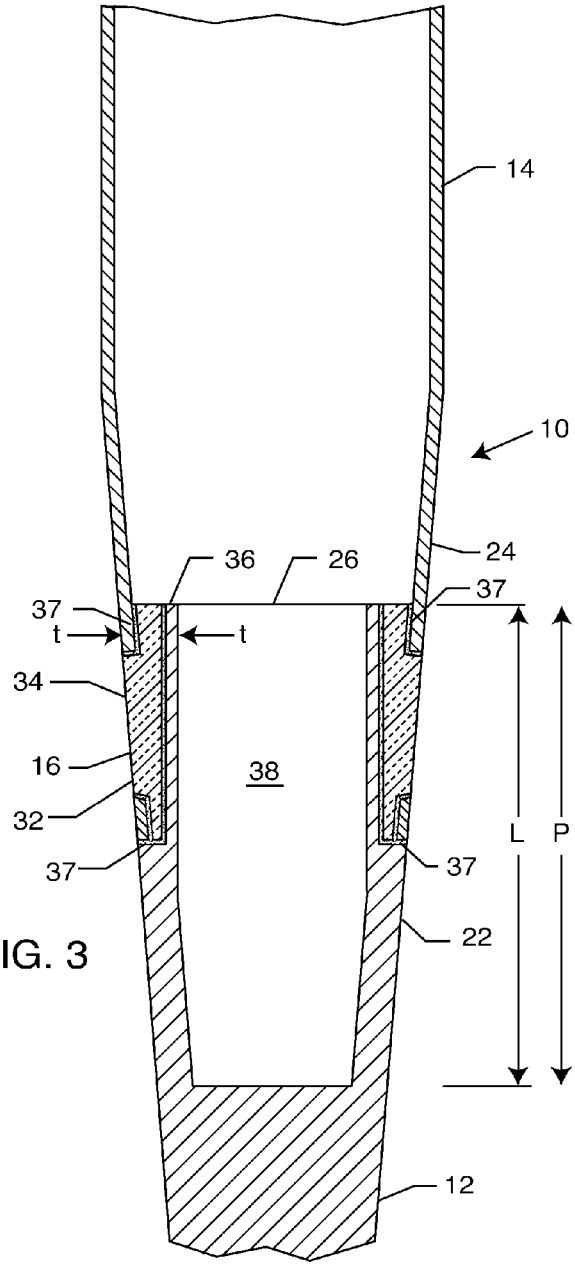
FIG. 3 is a cross-sectional view taken generally along the line 3-3 of FIG. 1, showing the engagement of the bat barrel, bat handle, and mechanism for interconnecting the bat barrel and the handle of FIG. 2.
Figure 4:
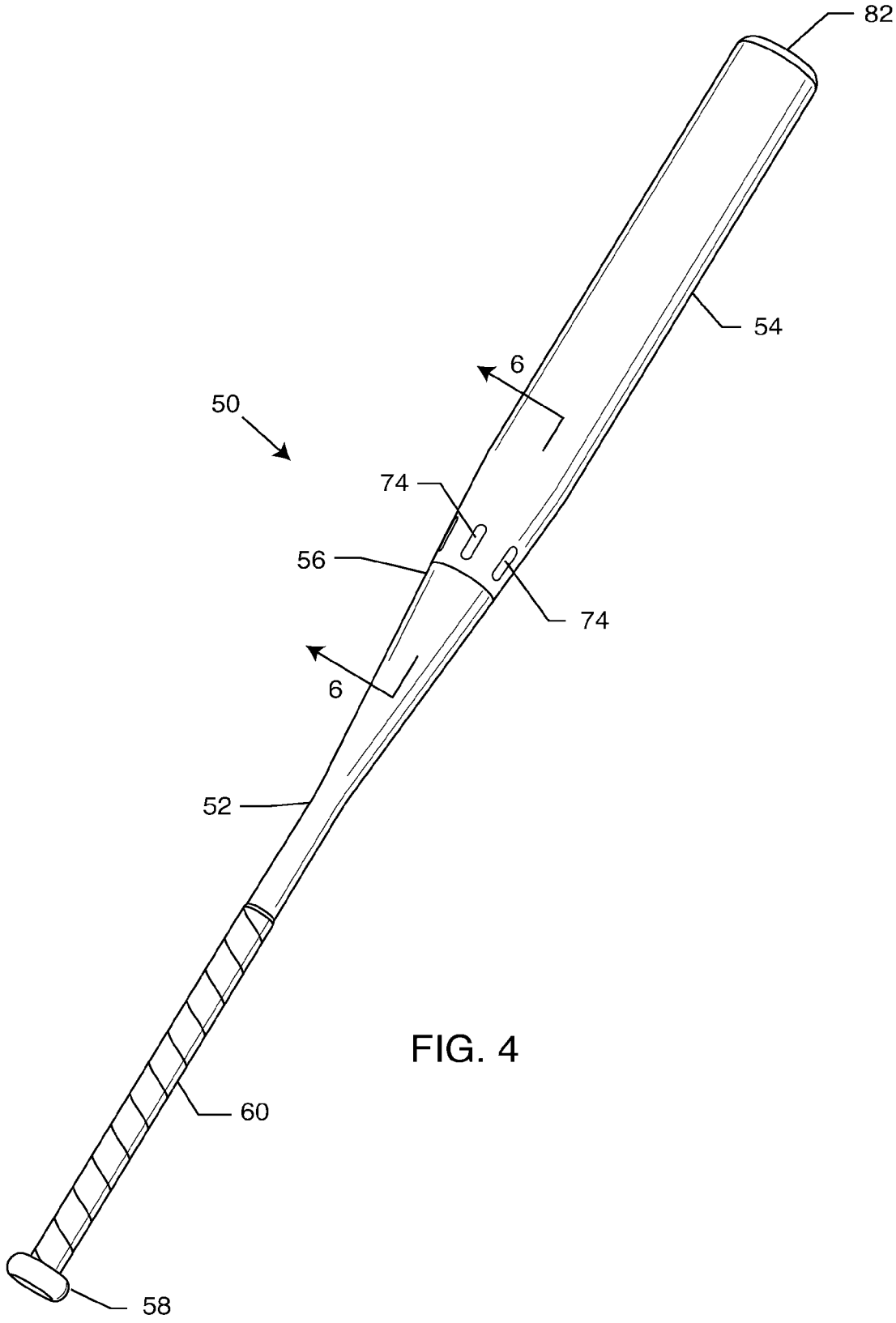
FIG. 4 is a perspective view of another baseball bat embodying the present invention.
Figure 5:
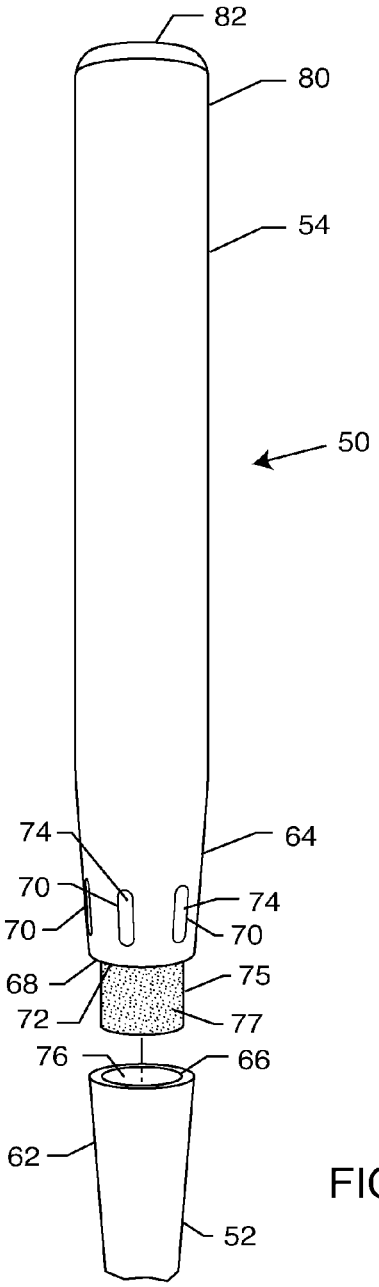
FIG. 5 is an exploded perspective view of a bat barrel, bat handle, and mechanism for interconnecting the bat barrel and the handle to form the baseball bat of FIG. 4.

As shown in FIGS. 1-3 for purposes of illustration, the present invention is concerned with a multi-component bat 10 which has an elongate hollow handle shell portion 12, an elongate hollow barrel shell portion 14 and an intermediate cylindrically tapered section 16 interconnecting the handle portion 12 and the barrel portion 14. A knob 18 is securely attached to the end of the handle portion 12 by a variety of means, including, but not limited to, binding agents, glues, adhesives, or the like. The knob 18 may be made of various materials including, without limitation, aluminum, polyurethane, polycarbonate, a composite material, magnesium, Zytel, Delrin, plastic, or the like. Also, the handle portion 12 is typically wrapped with a grip 20 comprised of rubber, polyurethane, leather or the like, for comfort.

The handle and barrel portions 12, 14 may be made of various materials including, without limitation, wood, a lightweight yet durable metal (e.g., aluminum, titanium, magnesium, or an alloy thereof), a composite material (e.g., fiberglass, carbon fibers, or a combination of glass and carbon fibers (50/50 glass to carbon, 80/20 glass to carbon for a very flexible bat, 20/80 glass to carbon for a very stiff bat or any other ratio of glass to fiber in order to obtain a desired flex in the bat 10)) or the like. Each of the portions 12, 14 may be made of the same material or they may be made of different materials. Preferably, the handle portion is comprised of a composite material and the barrel portion 14 is comprised of a 6000 or 7000 series aluminum alloy in which zinc is the major alloying element coupled with a smaller percentage of magnesium, resulting in a heat-treatable alloy of very high strength. The barrel portion 14 is finished to a mechanical strength of T6/T7 Temper. In the alternative, the handle and barrel portions 12, 14 may both be made of composite materials (of equal or differing hardness) or metal (of equal or differing hardness). In another alternative, the barrel portion 14 may be made of composite material and the handle portion 12 may be made of metal.

The handle and barrel portions 12, 14 each include a tapered first end 22, 24 having an aperture 26, 28. The intermediate tapered section 16 of the bat 10 is defined when the tapered first end 22 of the handle portion 12 engages a plurality (preferably six to eight) of slots 30 disposed around the tapered first end 24 of the barrel portion 14.

The intermediate section 16 includes a connector 32 attached to the first end 22 of the handle portion 12. The connector 32 comprises, at least in part, the intermediate tapered section 16 between the barrel and handle portions 14, 12. The connector 32, in the form of a hollow, exteriorly tapered sleeve, is coaxially disposed around an exterior of the first end 22 of the handle portion 12 and has a plurality (preferably six to eight) of outwardly extending risers or protrusions 34 for engaging respective slots 30 in the barrel portion 14. The protrusions 34 are sized and shaped to engage the slots 30 in an interference friction-fit engagement. The slots 30 and protrusions 34 may be various shapes including, circular, oblong, rectangular, ovoid, polygons or the like. The connector 32 is coaxially disposed between the barrel portion 14 and the handle portion 12 for interconnecting the barrel and handle portions 14, 12 in an aligned relation, to return energy and power to the barrel portion 14 that emanates from the barrel portion due to an impact of a ball (not shown) on the barrel portion 14. The shape of the slots 30 are helpful in reducing the speed of vibration created when the ball contacts the bat 10 and reduce the sensation of impact that a person holding the bat 10 feels when the ball impacts the bat 10, creating vibrations that travel along the bat 10 from the point of impact to the grip 20 of the handle portion 12.

The handle portion 12 includes a cylindrical guide 36 extending longitudinally from the first end 22 of the handle portion 12. The aperture 26 of the first end 22 of the handle portion 12 is the entrance to an interior portion 38 of the guide 36 that extends into the handle portion 12. The cylindrical interior diameter of the connector 32 closely matches the cylindrical exterior diameter of the tapered guide 36 in order to provide tight engagement of the connector 32 and guide 36. The connector 32 is also adhered about the guide 36 by a conventional adhesive, glue or bonding agent 37. When the handle portion 12 engages the barrel portion 14, a section of the first end 24 of the barrel portion 14 envelopes at least a portion of the first end 22 of the handle portion 12 and the section of the first end 24 of the barrel portion 14 also envelopes the connector 32. The slots 30 of the barrel portion 14 receive a portion (i.e., the protrusions 34) of the connector 32 therein, reducing speed of vibrations traveling from the barrel to the handle, created when the ball contacts the bat 10.

The engagement of the barrel portion 14, the handle portion 12 and the connector 32 provides a generally continuous exterior surface of the baseball bat 10. This is because the angle of the tapered exterior surface of the protrusions 34 matches the angles of the tapered first ends 22, 24 of the handle and barrel portions 12, 14; the angle of the first tapered ends 22, 24 being between zero and forty-five degrees. The engagement of the barrel portion 14, the handle portion 12 and the connector 32 provides a point of connection that serves as a block that will help return energy and power to the sweet spot located in the barrel portion 14 at the impact between the bat 10 and the ball. This block also helps to create a larger sweet spot on the barrel portion 14. the protrusions 34 prevent twisting of the handle portion 12 relative to the barrel portion 14.

The connector 32 is comprised of polyurethane, or polycarbonate, a composite material (e.g., fiberglass, carbon fibers, or a combination of glass and carbon fibers), metal (e.g., aluminum, titanium, magnesium, or an alloy thereof), or an elastomeric material (e.g., solid rubber, high performance rubber foam, silicone or similar materials). The connector 32 can be made of transparent material (colored or non-colored) or an opaque material (colored or non-colored). The connector 32 may be solid or partially hollowed out to decrease its weight.

The bat 10 may be assembled in a number of ways. In one particular way, the handle portion 12 is mated with the barrel portion 14 by inserting the handle portion 12 through an upper end 40 of the barrel portion 14 and out through the aperture 28 of the first end 24 of the barrel portion 14. Prior to this, the connector 32 had been secured over the guide 36 extending from the first end 22 of the handle portion 12 by the conventional adhesive, glue or bonding agent 27. The connector 32, held on the guide 36, is moved towards the first end 24 of the barrel portion 14 until the slots 30 of the barrel portion 14 are aligned with the protrusions 34 of the connector 32. At that point, the protrusions 34 engage the slots 30 to secure the handle portion 12 to the barrel portion 14.

Interconnection of the handle portion 12, connector 32 and barrel portion 14 results in the intermediate tapered section 16. The components of the intermediate tapered section 16 tightly fit together to isolate vibrations which insulates the handle portion 12 from vibrations generated in the barrel portion 14 when a ball strikes the barrel portion 14. The length of the intermediate tapered section 16, especially the connector 32 and the guide 36, will be varied based on the size and type of bat (e.g., adult baseball bat, youth baseball bat, softball bat or the like). A high strength bonding glue 37 (e.g., rubberized glue, rubber cement, etc.) may be applied to all joins to secure all the connections, especially between the connector 32 and the guide 36 of the handle portion 12. The glue also helps to dampen vibrations, fill in the gaps and allow additional flexibility. The flexibility of the glue 37 helps to give the bat 10 a whipping effect since the two materials that form, respectively, the handle and barrel portions 12, 14 flex at different rates (the barrel portion 14 flexing more than the handle portion 12) and the glue 37 provides a flexible cushion along the interface of the handle portion 12, connector 32 and barrel portion 14.

The second or upper end 40 of the barrel portion 14 is typically open and directed inward for acceptance and retention of a cap or end plug 42. The end plug 42 is typically comprised of urethane, polyurethane, Zytel or the like. The end plug 42 has a circumferential groove 44 which accepts an inwardly directed annular lip (not shown) of the barrel portion 14. The end plug 42 is then secured to the end 40 of the barrel portion 14.

As shown in FIGS. 1-3 for purposes of illustration, the present invention is concerned with a multi-component bat 50 which has an elongate hollow handle shell portion 52, an elongate hollow barrel shell portion 54 and an intermediate cylindrically tapered section 56 interconnecting the handle portion 52 and the barrel portion 54. A knob 58 is securely attached to the end of the handle portion 52 by a variety of means, including, but not limited to, binding agents, glues, adhesives, or the like. The knob 58 may be made of various materials including, without limitation, aluminum, polyurethane, polycarbonate, a composite material, magnesium, Zytel, Delrin, plastic, or the like. Also, the handle portion 52 is typically wrapped with a grip 60 comprised of rubber, polyurethane, leather or the like, for comfort.

The handle and barrel portions 52, 54 may be made of various materials including, without limitation, wood, a lightweight yet durable metal (e.g., aluminum, titanium, magnesium, or an alloy thereof), a composite material (e.g., fiberglass, carbon fibers, or a combination of glass and carbon fibers (50/50 glass to carbon, 80/20 glass to carbon for a very flexible bat, 20/80 glass to carbon for a very stiff bat or any other ratio of glass to fiber in order to obtain a desired flex in the bat 50)) or the like. Each of the portions 52, 54 may be made of the same material or they may be made of different materials. Preferably, the handle portion is comprised of a composite material and the barrel portion 54 is comprised of a 6000 or 7000 series aluminum alloy in which zinc is the major alloying element coupled with a smaller percentage of magnesium, resulting in a heat-treatable alloy of very high strength. The barrel portion 54 is finished to a mechanical strength of T6/T7 Temper. In the alternative, the handle and barrel portions 52, 54 may both be made of composite materials (of equal or differing hardness) or metal (of equal or differing hardness). In another alternative, the barrel portion 54 may be made of composite material and the handle portion 52 may be made of metal.

The handle and barrel portions 52, 54 each include a tapered first end 62, 64 having an aperture 66, 68. The intermediate tapered section 56 of the bat 50 is defined when the tapered first end 62 of the handle portion 52 engages a plurality (preferably six to eight) of slots 70 disposed around the tapered first end 64 of the barrel portion 54.

The intermediate section 56 includes a connector 72 attached to the first end 62 of the handle portion 52. The connector 72 comprises, at least in part, the intermediate tapered section 56 between the barrel and handle portions 54, 52. The connector 72, in the form of an exteriorly tapered sleeve having a first tapered extension 73 and a second cylindrical extension 75, is coaxially disposed with the first end 62 of the handle portion 52 and has a plurality (preferably six to eight) of outwardly extending risers or protrusions 74 for engaging respective slots 70 in the barrel portion 54. The protrusions 74 are sized and shaped to engage the slots 70 in an interference friction-fit engagement. The slots 70 and protrusions 74 may be various shapes including, circular, oblong, rectangular, ovoid, polygons or the like. The connector 72 is coaxially disposed between the barrel portion 54 and the handle portion 52 for interconnecting the barrel and handle portions 54, 52 in an aligned relation, to return energy and power to the barrel portion 54 that emanates from the barrel portion due to an impact of a ball (not shown) on the barrel portion 54. The shape of the slots 70 are helpful in reducing the speed of vibration created when the ball contacts the bat 50 and reduce the sensation of impact that a person holding the bat 50 feels when the ball impacts the bat 50, creating vibrations that travel along the bat 50 from the point of impact to the grip 60 of the handle portion 52.

The handle portion 52 includes a cylindrical bore 76 extending longitudinally from the first end 62 of the handle portion 52 towards the knob 58. The aperture 66 of the first end 62 of the handle portion 52 is the entrance to the bore 76 that extends into the handle portion 52. The cylindrical exterior diameter of the second extension 75 of the connector 72 closely matches the cylindrical diameter of the bore 76 in order to provide tight engagement of the connector 72 and bore 76. The second extension 75 of the connector 72 is also adhered within the bore 76 by a conventional adhesive, glue or bonding agent 77 with adhesive, glue or bonding agent 77 also being positioned between all interfaces of the connector 72 and the handle portion 52. When the handle portion 52 engages the barrel portion 54, the first end 64 of the barrel portion 54 abuts the first end 62 of the handle portion 52 (with adhesive, glue or bonding agent 77 disposed therebetween) and the section of the first end 64 of the barrel portion 54 also envelopes the connector 72. The slots 70 of the barrel portion 54 receive a portion (i.e., the protrusions 74) of the connector 72 therein, reducing speed of vibrations traveling from the barrel to the handle, created when the ball contacts the bat 50. The tapered exterior diameter of the first extension 73 of the connector 72 closely matches the tapered interior diameter of the first end 64 of the barrel portion 54 in order to provide tight engagement of the connector 72 and the first end 64 of the barrel portion 54. The adhesive, glue or bonding agent 77 is also positioned along the interfaces of the connector 72 and the barrel portion 54.

The engagement of the barrel portion 54, the handle portion 52 and the connector 72 provides a generally continuous exterior surface of the baseball bat 50. This is because the angle of the tapered exterior surface of the protrusions 74 matches the angles of the tapered first ends 62, 64 of the handle and barrel portions 52, 54; the angle of the first tapered ends 62, 64 being between zero and forty-five degrees. The engagement of the barrel portion 54, the handle portion 52 and the connector 72 provides a point of connection that serves as a block that will help return energy and power to the sweet spot located in the barrel portion 54 at the impact between the bat 50 and the ball. This block also helps to create a larger sweet spot on the barrel portion 54. The protrusions 74 prevent twisting of the handle portion 52 relative to the barrel portion 54.

The connector 72 is comprised of polyurethane, or polycarbonate, a composite material (e.g., fiberglass, carbon fibers, or a combination of glass and carbon fibers), metal (e.g., aluminum, titanium, magnesium, or an alloy thereof), or an elastomeric material (e.g., solid rubber, high performance rubber foam, silicone or similar materials). The connector 72 can be made of a transparent material (colored or non-colored) or an opaque material. The connector 72 may be solid or partially hollowed out to decrease its weight.

The bat 50 may be assembled in a number of ways. In one particular way, the handle portion 52 is mated with the barrel portion 54 by inserting the first end 64 of the barrel portion 54 over the first end 62 of the handle portion 52, with the second extension 75 of the connector 72 passing into the bore 76 of the handle portion. Prior to this, the connector 72 had been secured within the barrel portion 54. The connector 72 is moved towards the first end 64 of the barrel portion 54 until the slots 70 of the barrel portion 54 are aligned with the protrusions 74 of the connector 72. At that point, the protrusions 74 engage the slots 70 to secure the handle portion 52 to the barrel portion 54. The connector 72 is secured within the bore 76 extending from the first end 62 of the handle portion 62 by the conventional adhesive, glue or bonding agent 77.

Interconnection of the handle portion 52, connector 72 and barrel portion 54 results in the intermediate tapered section 56. The components of the intermediate tapered section 56 tightly fit together to isolate vibrations which insulates the handle portion 52 from vibrations generated in the barrel portion 54 when a ball strikes the barrel portion 54. The length of the intermediate tapered section 56, especially the connector 72 and the bore 76, will be varied based on the size and type of bat (e.g., adult baseball bat, youth baseball bat, softball bat or the like). The high strength bonding glue 77 (e.g., rubberized glue, rubber cement, etc.) may be applied to all joins to secure all the connections, especially between the connector 72 and the guide 76 of the handle portion 52. The glue also helps to dampen vibrations, fill in gaps and allow additional flexibility. The flexibility of the glue 77 helps to give the bat 50 a whipping effect since the two materials that form, respectively, the handle and barrel portions 52, 54 flex at different rates (the barrel portion 54 flexing more than the handle portion 52) and the glue 77 provides a flexible cushion along the interface of the handle portion 52, connector 72, and barrel portion 54.

A second or upper end 80 of the barrel portion 54 is typically open and directed inward for acceptance and retention of a cap or end plug 82. The end plug 82 is typically comprised of urethane, polyurethane, Zytel or the like. The end plug 82 has a circumferential groove 84 which accepts an inwardly directed annular lip (not shown) of the barrel portion 54. The end plug 82 is then secured to the end 80 of the barrel portion 54.

Examples of several methods of manufacturing the bat 10, 50 of the present invention will now be described. It is to be understood that the methods used may be altered in some respects while still creating a bat 10, 50 having the desired characteristics. Also, certain dimensions, materials, temperatures, etc. may be altered depending upon the size, weight and intended use of the resulting bat 10, 50. The connection between the handle 12, 52 and barrel portions 14, 54 allows the balance between the portions 12, 52, 24, 54 to be adjusted so that the majority of the weight of the bat 10, 50 is at the intermediate section 16, 56. The position of the intermediate section 16, 56 along the length of the bat 10, 50 may be adjusted as well as the length and/or thickness of the intermediate section 16, 56. In general, the barrel portion 14, 54 has a minimum thickness of 0.070 inches and a maximum thickness of 0.115 inches. The thickness of the connection area of the bat 10, 50 is determined by the weight/size of the bat 10, 50.

The composite material handle portions 12, 52 may be manufactured using a variety of techniques. These technique include, but are not limited to: resin transfer molding (RTM); vacuum resin transfer molding (VRTM); filament winding and wrapping technique. Using RTM, various layers of the composite material are premanufactured to form the handle portion 12, 52. Wrapping technique provides a layer by layer formation of the handle portion 12, 52 that allows the manufacturer to control the flexibility of the handle portion 12, 52. In general, the handle portion 12, 52 is formed by approximately sixteen to twenty layers of composite material, depending on fiber type, fiber thickness (0.001-0.003 inches), fiber area weight (FAW) and flex.

A metal tube, such as an aluminum alloy tube, is provided at predetermined lengths and weights prior to manufacturing. For purposes of the following example, an aluminum alloy tube is provided for manufacture of the barrel portion 14, 54.

The metal tube is first thermally treated. This is often referred to in the art as an annealing process. The thermal treatment softens the metal by removing the stress resulting from cold working. This process is to be repeated after a certain amount of cold work has been performed on the metal tubes. Before each cold forming process, the temperature of an anneal oven is set at four hundred ten degrees centigrade. The aluminum tube is heated in the oven at this temperature for approximately three hours. The oven temperature is then decreased by twenty degrees Centigrade per hour, after the three hour soak time, until the temperature of the tube has reached twenty degrees Centigrade. The aluminum tube is then heated at a temperature of two hundred thirty degrees Centigrade for two hours, at which point the oven temperature is reset to one hundred forty degrees Centigrade. The tube is removed from the oven when the temperature of the oven has reached one hundred forty degrees Centigrade.

The tube is then cleaned. During the annealing process, an oxidation scale develops on the surface of the aluminum tube. An acid cleaning process is required to remove the oxidation scale. The tube is soaked in a sulfuric acid solution for approximately thirty minutes to remove the oxidation scale each time the tube is annealed.

The tube is then formed into the barrel portion 14, 54 of desired thickness, contour and length. This wall forming process is a cold working process. It is performed to obtain a wall of a desired thickness. Several cold forming passes may have to be performed depending upon several factors including metal type and the type of bat 10, 56 desired. In the instant example, the tube forming the aluminum barrel portion 14, 54 is subject to the cold working process on the outside diameter and the wall thickness simultaneously to obtain a wall thickness ranging from the minimum thickness of 0.070 inches to the maximum thickness of 0.115 inches.

The barrel portion 14, 54 is then cleaned. A degreasing process is required to remove all lubricants and residue substances out of the aluminum barrel portion 14, 54. This is performed using an ultrasonic method with a detergent agent before and after the aluminum tube is annealed.

The barrel portion 14, 54 is then cut, trimmed and swaged to a desired length and contour. A thin end of the aluminum barrel portion 14, 54 is trimmed to a predetermined length. It is important to have the thin ends of the aluminum barrel portion 14, 54 squarely trimmed to avoid folding problems when the tube is swaged by a rotary taper swager. The aluminum barrel portion 14, 54 is swaged with a rotary swaging machine to obtain the desired contour shape and wall thickness.

The connector 32, 72 may be formed using conventional methods, including, but not limited to, injection molding or the like. The connector 32, 72 is shaped to obtain a desired contoured shape that will later assist in giving the exterior surface of the bat 10, 50 a generally continuous appearance.

If necessary, after shaping, the barrel portion 14, 54 is cut to the desired length.

The barrel portion 14, 54 is then thermally treated, quenched and aged. It is commonly known in the art to expose metal or alloys to a heating and cooling treatment to obtain desired conditions, properties and an increase in strength. The barrel portion 14, 54 is heat treated to obtain the highest tensile and yield strengths. The required temperature and time for the solution heat treatment is twenty-seven minutes at a temperature of four hundred eighty degrees centigrade. After the barrel portion 14, 54 is heat treated, it is quenched immediately with either air or water. Quenching is a controlled rapid cooling of a metal from an elevated temperature by contact with a liquid, gas or solid. Precipitation from solid solution results in a change in properties of the alloy, usually occurring rapidly at elevated temperatures. The barrel portion 14, 54 is aged in an oven for twelve hours at one hundred thirty five degrees centigrade. The tapered end 24, 64 of the barrel portion 14, 54, as well as the slots 30, 70 are then machined. The end 24, 64 of the barrel portion 14, 54 is machined to achieve squareness and an angled interior surface in order to snugly engage the connector 32, 72 and the handle portion 12, 52.

The barrel portion 14, 54 is then cleaned again. Due to the treatments, the barrel portions 14, 54 oxidizes. This oxidation is removed by an anodizing process. The barrel portion 14, 54 is anodized for five minutes. To eliminate all possible contaminations, the surface of the barrel portion 14, 54 is then thoroughly cleaned with methyl ethyl ketone.

At this point, the barrel portion 14, 54 is assembled as outlined above, with respect to FIGS. 1-5.

Thereafter, approximately a one half inch portion of the open barreled end 40, 80 is rolled inward at a ninety degree angle to accommodate the end plug 42, 82. If necessary, the protruded portion of the rolled portion is machined to achieve an opening of one and a quarter inches in diameter for installing the end plug 42, 82.

The bat 10, 50 is then polished and decorated. Any appropriate methods of polishing and decoration, as are well known in the art, can be applied. In the preferred embodiment, the outer surface of the barrel portion 14, 54 is exposed to sodium hydroxide to strip an anodize coating created during the manufacturing process as well as to prepare the outer surface for anodic coating process. Typically, the concentration of the sodium hydroxide is fifty grams per liter. The outer surface of the barrel portion 14, 54 is mechanically polished to obtain a mirror finish. The external surface of the barrel portion 14, 54 is then anodized. In the alternative, the external surface of the barrel portion 14, 54 may be painted, chromed, powder-coated, or covered by some other method of decorative coating. The outer surface of the barrel portion 14, 54 may be decorated with a graphic by using various methods such as silk-screening, heat transferring, or pad stamping.

The bat 10, 50 is completed by attaching the knob 18, 58 typically by sluing the knob 18, 58 to an open end of the handle portion 12, 52 opposite the tapered end 22, 62. The grip 20, 60 and the end plug 42, 82 are also installed to finish the bat 10, 50.

In the alternative, the above described method of manufacturing the bat 10, 50 may be varied. For example, physical characteristics of the bat 10, 50 such as the length, wall thickness or diameter may be increased or decreased.

Figure 6:
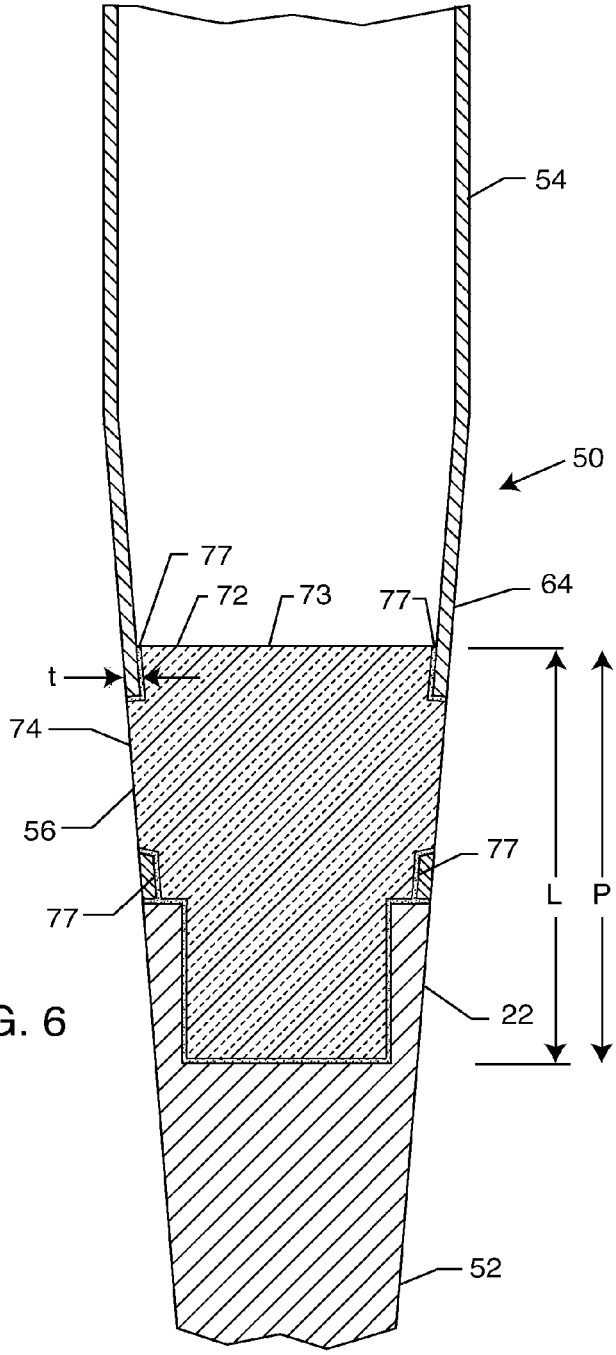
FIG. 6 is a cross-sectional view taken generally along line 6-6 of FIG. 4, showing the engagement of the bat barrel, bat handle, and mechanism for interconnecting the bat barrel and the handle of FIG. 5.

An important feature of the bat 10, 50 is the balance of the bat 10, 50. The balance of the bat 10, 50 affects a user's control of the bat 10, 50. The length L, thickness t and position P of the intermediate section 16, 56 of the bat 10, 50 affects the balance of the bat 10, 50, as seen in FIGS. 3 and 6, respectively.

Although constructed from affordable medium to high strength, light weight, and commercially available materials, the bat 10, 50 of the present invention offers the performance and advantages of expensive and high strength materials. The bat 10, 50 provides improved dent resistance. The bat 10, 50 also dampens the vibrations created when traditional metal bats hit the ball that would otherwise sting the hitter's hand when a bat contacts a ball. Premature longitudinal cracking of the barrel portion 14, 54 caused in traditional bats with thin wall thicknesses and high stress conditions, is avoided in the present invention.

The above-described embodiments of the present invention are illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention.

What is claimed is:

1. A multi-component baseball bat, comprising:

a bat barrel having a plurality of slots disposed uniformly around a perimeter of the bat barrel, extending from an inner surface of the bat barrel and through an outer surface of the bat barrel;

a bat handle having an upper end portion defining a bore; and a single piece, snap-fit connector having a lower extension configured for insertion within the bore of the handle, and an upper extension configured for insertion within the bat barrel and having protrusions extending therefrom for snap-fit insertion into the slots of the barrel, the connector coaxially disposed within the barrel and the handle for interconnecting the barrel and handle in an aligned relation.

2. The baseball bat of claim 1, wherein the engagement of the barrel, handle and connector provides a generally continuous exterior surface of the baseball bat when the handle engages the barrel.

3. The baseball bat of claim 1, wherein the connector protrusions in the slots of the barrel reduce speed of vibrations traveling from the barrel to the handle, created when a ball contacts the bat.

4. The baseball bat of claim 1, wherein the engagement of the barrel, handle and connector increases sweet spot size on the barrel.

5. The baseball bat of claim 1, wherein the protrusions in the slots of the barrel return energy and power to the barrel that emanates from the barrel due to an impact of a ball with the barrel.

6. The baseball bat of claim 1, wherein an exterior surface of the upper extension of the connector is of a tapered configuration substantially matching a taper of an inner surface of a lower portion of the bat barrel, and an exterior surface of the lower extension of the connector is of a cylindrical configuration substantially matching a cylindrical configuration of an inner surface of an upper portion of the handle.

7. The baseball bat of claim 6, wherein the protrusions are tapered such that an outer surface of each protrusion is substantially flush with an outer surface of the bat barrel.

8. The baseball bat of claim 1, wherein at least a portion of a lower edge of the bat barrel and at least a portion of an upper edge of the handle are disposed immediately adjacent to one another.

9. A multi-component baseball bat, comprising:

a bat barrel having a plurality of slots disposed uniformly around a perimeter of the bat barrel, extending from an inner surface of the bat barrel and through an outer surface of the bat barrel;

a bat handle having a guide extending therefrom; and a single piece, snap-fit connector comprising a hollow, tapered sleeve attached to and coaxially disposed around the guide, and having a plurality of outwardly extending protrusions configured for snap-fit insertion into the plurality of slots in the barrel, the connector being coaxially disposed between the barrel and the handle guide for interconnecting the barrel and handle in an aligned relation.

10. The baseball bat of claim 9, wherein the engagement of the barrel, handle and sleeve provides a generally continuous exterior surface of the baseball bat when the handle engages the barrel.

11. The baseball bat of claim 9, wherein the handle guide extends longitudinally from the handle and is of a generally cylindrical configuration; and wherein an inner surface of the connector sleeve is generally cylindrical so as to substantially mate with the handle guide.

12. The baseball bat of claim 9, wherein the protrusions in the slots of the barrel return energy and power to the barrel that emanates from the barrel due to an impact of a ball with the barrel.

13. The baseball bat of claim 9, wherein an exterior surface of the connector is of a tapered configuration substantially matching a taper of an inner surface of a lower portion of the bat barrel.

14. The baseball bat of claim 13, wherein the protrusions are tapered such that an outer surface of each protrusion is substantially flush with an outer surface of the bat barrel.

15. The baseball bat of claim 9, wherein at least a portion of a lower edge of the bat barrel and at least a portion of an upper edge of the handle are disposed immediately adjacent to one another.

16. A process for assembling a multi-component baseball bat, comprising the steps of:

providing a bat barrels;

forming a plurality of slots through the bat barrel spread uniformly around a perimeter of the bat barrel;

selecting a bat handle having a guide extending from an end thereof;

inserting a hollow connector sleeve into the bat barrel such that protrusions on the connector sleeve form a snap-fit mechanical connection with the slots of the bat barrel; and attaching the hollow connector sleeve to the guide on the bat handle.

17. The process of claim 16, including the step of reducing the speed of vibrations traveling from the barrel to the handle when a ball contacts the bat.

18. The process of claim 16, wherein the inserting step includes the step of forming an energy block which increases sweet spot size on the barrel.

19. The method of claim 16, including the step of returning energy and power to the barrel that emanates from the barrel due to an impact of a ball on the barrel.

20. The method of claim 16, including the step of forming the connector so as to have a tapered configuration matching adjoining surfaces of the bat barrel and handle guide.

21. A process for assembling a multi-component baseball bat, comprising the steps of:

providing a bat barrel;

forming a plurality of slots through the bat barrel snread uniformly around a perimeter of the bat barrel;

selecting a bat handle having a bore in an end thereof;

inserting a first extension of a snap-fit mechanical connector having a plurality of protrusions into an end of the bat barrel such that the protrusions extend into the bat barrel slots; and inserting a second extension of the snap-fit mechanical connector into the bore of the handle, such that the bat barrel and handle are interconnected.

22. The process of claim 21, including the step of reducing energy transfer from the bat barrel to the handle when a ball impacts the bat barrel.

23. The method of claim 21, including the step of forming the snap-fit mechanical connector so as to have a tapered configuration matching adjoining surfaces of the bat barrel and handle bore.

* * * * *

UNITED STATES PATENT AND TRADEMARK OFFICE

CERTIFICATE OF CORRECTION

PATENT NO. : 7,381,141 B2
APPLICATION NO. : 11/307994
DATED : June 3, 2008
INVENTOR(S) : Van Nguyen It is certified that error appears in the above-identified patent and that said Letters Patent is hereby corrected as shown below:

In Claim 21, Line 34, replace “snread” with --spread--.

Signed and Sealed this

Twenty-sixth Day of August, 2008

JON W. DUDAS
*Director of the United States Patent and Trademark Office*

UNITED STATES PATENT AND TRADEMARK OFFICE

CERTIFICATE OF CORRECTION

PATENT NO. : 7,381,141 B2
APPLICATION NO. : 11/307994
DATED : June 3, 2008
INVENTOR(S) : Van Nguyen It is certified that error appears in the above-identified patent and that said Letters Patent is hereby corrected as shown below:

Column 12, In Claim 21, Line 34, replace “snread” with --spread--.

This certificate supersedes the Certificate of Correction issued August 26, 2008.

Signed and Sealed this

Twenty-third Day of September, 2008

JON W. DUDAS
*Director of the United States Patent and Trademark Office*